US008104126B2

(12) United States Patent
Caminade et al.

(10) Patent No.: US 8,104,126 B2
(45) Date of Patent: Jan. 31, 2012

(54) METHOD OF INFLATING, IN ALTERNATING MANNER, A SUPPORT DEVICE HAVING INFLATABLE CELLS, AND A DEVICE FOR IMPLEMENTING THE METHOD

(75) Inventors: Jean-Luc Caminade, Saint Jean de Vedas (FR); Jean-Marie Basilio, Meze (FR); Olivier Coupard, Montpelier (FR); Thierry Flocard, Montpellier (FR)

(73) Assignee: Hill-Rom Industries SA, Montpellier (FR)

( * ) Notice: Subject to any disclaimer, the term of this patent is extended or adjusted under 35 U.S.C. 154(b) by 407 days.

(21) Appl. No.: 12/249,986

(22) Filed: Oct. 13, 2008

(65) Prior Publication Data

US 2009/0100604 A1 Apr. 23, 2009

(30) Foreign Application Priority Data

Oct. 18, 2007 (FR) ..... 07 58412

(51) Int. Cl.
*A47C 27/08* (2006.01)

(52) U.S. Cl. ..... 5/715; 5/655.3; 5/710; 5/713

(58) Field of Classification Search ..... 5/706, 710, 5/713, 715, 609, 614, 615, 644, 654, 655.3
See application file for complete search history.

(56) References Cited

U.S. PATENT DOCUMENTS 1,147,560 A 7/1915 Shurtleff
1,772,310 A 8/1930 Hart
2,437,006 A 3/1948 Simpson
(Continued)

FOREIGN PATENT DOCUMENTS

EP 0 168 213 S2 1/1986
(Continued)

OTHER PUBLICATIONS

French Search Report for FR 0758412 (6 pages), dated Jun. 19, 2008.

*Primary Examiner* — Robert G Santos
*Assistant Examiner* — Nicholas Polito
(74) *Attorney, Agent, or Firm* — Barnes & Thornburg LLP

(57) ABSTRACT

A method of inflating, in alternating manner, inflatable cells of a support device for supporting an element to be supported is provided, which device is of the mattress type for supporting the body of a patient, said mattress being made up of cells that are inflatable with a fluid, in particular air, and having at least one zone made up of first and second series of inflatable cells referred to respectively as "first" cells and as "second" cells, the cells of each series communicating fluidly with one another and with inflation means, in which method alternating deflation and re-inflation cycles are performed during which each of said series of cells is deflated and then re-inflated in alternation and in succession, said first cells being deflated and then re-inflated simultaneously respectively with the re-inflation and with the deflation of said second cells, the alternating deflation and re-inflation of said first and second cells of the support device taking place in a cycle controlled by said inflation means being switched on/off, wherein the switching on/off of said inflation means is controlled as a function of the values of the pressures of the fluid measured inside said cells and of comparison of said values with at least one reference pressure value determined as a function of the morphology of the patient.

14 Claims, 8 Drawing Sheets

U.S. PATENT DOCUMENTS

| | | | | |
|---|---|---|---|---|
| 2,460,245 | A | | 1/1949 | Summerville |
| 2,719,986 | A | | 10/1955 | Rand |
| 2,896,612 | A | | 7/1959 | Bates et al. |
| 2,998,817 | A | | 9/1961 | Armstrong |
| 3,008,465 | A | | 11/1961 | Gal |
| 3,148,391 | A | | 9/1964 | Whitney |
| 3,199,124 | A | | 8/1965 | Grant |
| 3,297,023 | A | | 1/1967 | Foley |
| 3,317,934 | A | | 5/1967 | Hinrichs |
| 3,390,674 | A | | 7/1968 | Jones |
| 3,394,415 | A | | 7/1968 | Parker |
| 3,446,203 | A | | 5/1969 | Murray |
| 3,462,778 | A | | 8/1969 | Whitney |
| 3,467,081 | A | | 9/1969 | Glass |
| 3,595,223 | A | | 7/1971 | Castagna |
| 3,653,083 | A | | 4/1972 | Lapidus |
| 3,674,019 | A | | 7/1972 | Grant |
| 3,678,520 | A | | 7/1972 | Evans |
| 3,701,173 | A | | 10/1972 | Whitney |
| 3,919,730 | A | | 11/1975 | Regan |
| 4,066,072 | A | | 1/1978 | Cummins |
| 4,068,334 | A | | 1/1978 | Randall |
| 4,133,305 | A | | 1/1979 | Steuer |
| 4,175,297 | A | | 11/1979 | Robbins et al. |
| 4,181,288 | A | | 1/1980 | Bylsma |
| 4,193,149 | A | | 3/1980 | Welch |
| 4,197,837 | A | | 4/1980 | Tringali et al. |
| 4,225,989 | A | | 10/1980 | Corbett et al. |
| 4,267,611 | A | | 5/1981 | Agulnick |
| 4,391,009 | A | | 7/1983 | Schild et al. |
| 4,551,874 | A | | 11/1985 | Matsumura et al. |
| 4,617,690 | A | | 10/1986 | Grebe |
| 4,622,706 | A | | 11/1986 | Takeuchi |
| 4,644,593 | A | | 2/1987 | O'Brien |
| 4,653,130 | A | | 3/1987 | Senoue et al. |
| 4,722,105 | A | | 2/1988 | Douglas |
| 4,730,604 | A | | 3/1988 | Boggs |
| 4,777,679 | A | | 10/1988 | DeLooper |
| 4,825,486 | A | | 5/1989 | Kimura et al. |
| 4,837,872 | A | | 6/1989 | DiMatteo et al. |
| 4,840,425 | A | | 6/1989 | Noble |
| 4,852,195 | A | | 8/1989 | Schulman |
| 4,999,861 | A | | 3/1991 | Huang |
| 5,003,654 | A | | 4/1991 | Vrzalik |
| 5,008,965 | A | | 4/1991 | Vrzalik |
| 5,010,608 | A | | 4/1991 | Barnett et al. |
| 5,022,385 | A | | 6/1991 | Harza |
| 5,029,939 | A | | 7/1991 | Smith et al. |
| 5,035,016 | A | | 7/1991 | Mori et al. |
| 5,044,029 | A | | 9/1991 | Vrzalik |
| 5,077,845 | A | | 1/1992 | Tokunaga et al. |
| 5,103,518 | A | | 4/1992 | Gilroy et al. |
| 5,109,560 | A | | 5/1992 | Uetake |
| 5,109,561 | A | | 5/1992 | Schild |
| 5,117,518 | A | * | 6/1992 | Schild ..... 5/713 |
| 5,138,729 | A | | 8/1992 | Ferrand |
| 5,142,719 | A | | 9/1992 | Vrzalik |
| 5,189,742 | A | | 3/1993 | Schild |
| 5,243,723 | A | | 9/1993 | Cotner et al. |
| 5,251,349 | A | | 10/1993 | Thomas et al. |
| 5,255,955 | A | | 10/1993 | Matosic |
| 5,257,430 | A | | 11/1993 | Yamaguchi |
| 5,267,364 | A | | 12/1993 | Volk |
| 5,267,365 | A | | 12/1993 | Walter |
| 5,269,030 | A | | 12/1993 | Pahno et al. |
| 5,313,679 | A | | 5/1994 | Yamaguchi |
| 5,345,629 | A | | 9/1994 | Ferrand |
| 5,357,641 | A | | 10/1994 | Schubert |
| 5,379,471 | A | | 1/1995 | Holdredge |
| 5,396,671 | A | | 3/1995 | Stacy |
| 5,419,347 | A | | 5/1995 | Carruth |
| 5,438,721 | A | | 8/1995 | Pahno et al. |
| 5,509,155 | A | | 4/1996 | Zigarac et al. |
| 5,537,095 | A | | 7/1996 | Dick et al. |
| 5,561,412 | A | | 10/1996 | Novak et al. |
| 5,564,142 | A | | 10/1996 | Liu |
| 5,579,775 | A | | 12/1996 | Dempsey et al. |
| 5,586,346 | A | | 12/1996 | Stacy et al. |
| 5,588,167 | A | | 12/1996 | Pahno et al. |
| 5,603,133 | A | | 2/1997 | Vrzalik |
| 5,606,754 | A | | 3/1997 | Hand et al. |
| 5,619,764 | A | | 4/1997 | Lopau |
| 5,638,565 | A | | 6/1997 | Pekar |
| 5,651,151 | A | | 7/1997 | Schild |
| 5,662,384 | A | | 9/1997 | O'Neill et al. |
| 5,678,891 | A | | 10/1997 | O'Neill et al. |
| 5,685,036 | A | | 11/1997 | Kopfstein et al. |
| 5,687,438 | A | * | 11/1997 | Biggie et al. ..... 5/654 |
| 5,701,622 | A | | 12/1997 | Biggie et al. |
| 5,702,536 | A | | 12/1997 | Carruth |
| 5,708,996 | A | | 1/1998 | Marenco |
| 5,713,841 | A | | 2/1998 | Graham |
| 5,745,941 | A | | 5/1998 | Miller, Sr. |
| 5,755,000 | A | | 5/1998 | Thompson |
| 5,774,917 | A | | 7/1998 | Liu |
| D397,443 | S | | 8/1998 | Fletcher et al. |
| D403,773 | S | | 1/1999 | Fletcher et al. |
| 5,901,393 | A | | 5/1999 | Pepe et al. |
| 5,918,336 | A | | 7/1999 | Lee et al. |
| 5,926,884 | A | | 7/1999 | Biggie et al. |
| 5,956,787 | A | | 9/1999 | James et al. |
| 5,960,494 | A | | 10/1999 | Gilliland et al. |
| 5,966,762 | A | | 10/1999 | Wu |
| 5,983,428 | A | | 11/1999 | Hannagan |
| 5,983,429 | A | | 11/1999 | Stacy et al. |
| 5,991,949 | A | | 11/1999 | Miller, Sr. et al. |
| 6,009,580 | A | | 1/2000 | Caminade et al. |
| 6,029,294 | A | | 2/2000 | Saringer |
| 6,053,879 | A | | 4/2000 | Leban et al. |
| 6,058,538 | A | | 5/2000 | Chapman et al. |
| 6,073,290 | A | | 6/2000 | Miller, Sr. |
| 6,085,372 | A | | 7/2000 | James et al. |
| 6,098,222 | A | | 8/2000 | Hand et al. |
| 6,134,732 | A | | 10/2000 | Chapman et al. |
| 6,151,740 | A | | 11/2000 | Morimoto et al. |
| 6,202,684 | B1 | | 3/2001 | Angel et al. |
| 6,212,719 | B1 | | 4/2001 | Thomas et al. |
| 6,216,300 | B1 | | 4/2001 | Hannagan |
| 6,223,369 | B1 | | 5/2001 | Maier et al. |
| 6,266,833 | B1 | | 7/2001 | Lin |
| 6,282,737 | B1 | | 9/2001 | Vrzalik |
| 6,321,400 | B1 | | 11/2001 | Gulino |
| 6,327,727 | B1 | | 12/2001 | Bocharnikov |
| 6,349,439 | B1 | | 2/2002 | Cook et al. |
| 6,412,129 | B1 | | 7/2002 | Wu |
| 6,499,160 | B2 | | 12/2002 | Hand et al. |
| 6,536,056 | B1 | | 3/2003 | Vrzalik et al. |
| 6,546,580 | B2 | | 4/2003 | Shimada |
| 6,560,804 | B2 | * | 5/2003 | Wise et al. ..... 5/713 |
| 6,571,825 | B2 | | 6/2003 | Stacy |
| 6,604,252 | B1 | | 8/2003 | Lee et al. |
| 6,653,607 | B2 | | 11/2003 | Ellis et al. |
| 6,668,408 | B2 | | 12/2003 | Ferrand et al. |
| 6,684,433 | B2 | | 2/2004 | Giori et al. |
| 6,691,355 | B1 | | 2/2004 | Liu |
| 6,711,771 | B2 | | 3/2004 | Cook et al. |
| 6,745,996 | B1 | | 6/2004 | Guthrie |
| 6,771,190 | B2 | | 8/2004 | Gordon |
| 6,789,284 | B2 | * | 9/2004 | Kemp ..... 5/713 |
| 6,813,790 | B2 | | 11/2004 | Flick et al. |
| 6,820,640 | B2 | | 11/2004 | Hand et al. |
| 6,823,549 | B1 | | 11/2004 | Hampton et al. |
| 6,826,795 | B2 | | 12/2004 | Wilkinson |
| 6,854,144 | B1 | | 2/2005 | Mehring, Jr. |
| 6,877,178 | B2 | | 4/2005 | Chapman et al. |
| 6,892,405 | B1 | | 5/2005 | Dimitriu et al. |
| 6,895,988 | B2 | | 5/2005 | Grant et al. |
| 6,904,631 | B2 | | 6/2005 | Vrzalik et al. |
| 6,910,238 | B2 | | 6/2005 | Biggie et al. |
| 6,924,467 | B2 | | 8/2005 | Ellis et al. |
| 6,928,681 | B1 | | 8/2005 | Stacy |
| 7,007,330 | B2 | | 3/2006 | Kuiper et al. |
| 7,028,358 | B2 | | 4/2006 | Liu |
| 7,080,422 | B2 | | 7/2006 | Ben-Levi |
| 7,107,640 | B2 | | 9/2006 | Chapman et al. |
| 7,191,482 | B2 | | 3/2007 | Romano et al. |
| 7,203,984 | B2 | | 4/2007 | Gardner et al. |

| | | | |
|---|---|---|---|
| 7,225,486 | B2 | 6/2007 | Jackson, III |
| 7,226,471 | B2 | 6/2007 | Heaton et al. |
| 2001/0008029 | A1 | 7/2001 | Thomas et al. |
| 2001/0023511 | A1 | 9/2001 | Wilkinson |
| 2002/0016995 | A1 | 2/2002 | Cook et al. |
| 2002/0050010 | A1 | 5/2002 | Shimada |
| 2002/0133877 | A1 | 9/2002 | Kuiper et al. |
| 2002/0133882 | A1 | 9/2002 | Chapman et al. |
| 2002/0144343 | A1 | 10/2002 | Kuiper et al. |
| 2003/0024051 | A2 | 2/2003 | Wilkinson |
| 2003/0051293 | A1 | 3/2003 | Chapman et al. |
| 2003/0145386 | A1 | 8/2003 | Kemp |
| 2003/0182728 | A1 | 10/2003 | Chapman et al. |
| 2003/0188388 | A1 | 10/2003 | Boso et al. |
| 2003/0208848 | A1 | 11/2003 | Flick et al. |
| 2003/0208849 | A1 | 11/2003 | Wilkinson |
| 2003/0215340 | A1 | 11/2003 | Chung |
| 2004/0068801 | A1 | 4/2004 | Wilkinson |
| 2004/0074004 | A1 | 4/2004 | Boso et al. |
| 2004/0112891 | A1 | 6/2004 | Ellis et al. |
| 2004/0226102 | A1 | 11/2004 | Hampton et al. |
| 2004/0237203 | A1 | 12/2004 | Romano et al. |
| 2004/0255386 | A1 | 12/2004 | Liu |
| 2004/0256588 | A1 | 12/2004 | Guthrie |
| 2004/0261182 | A1 | 12/2004 | Biggie et al. |
| 2005/0044634 | A1 | 3/2005 | Wang |
| 2005/0125905 | A1 | 6/2005 | Wilkinson |
| 2005/0166328 | A1 | 8/2005 | Ben-Levi |
| 2005/0177952 | A1 | 8/2005 | Wilkinson et al. |
| 2005/0204476 | A1 | 9/2005 | Roff et al. |
| 2005/0262638 | A1 | 12/2005 | Libunao |
| 2006/0085919 | A1 | 4/2006 | Kramer et al. |
| 2006/0101580 | A1 | 5/2006 | Biggie et al. |
| 2006/0123552 | A1 | 6/2006 | Ben-Levi |
| 2006/0253992 | A1 | 11/2006 | Chapman |
| 2007/0101506 | A1 | 5/2007 | Pirzada |
| 2007/0118993 | A1 | 5/2007 | Bates |
| 2007/0143928 | A1 | 6/2007 | Biggie et al. |
| 2007/0157391 | A1 | 7/2007 | Jackson, III |
| 2007/0163052 | A1 | 7/2007 | Romano et al. |
| 2007/0186349 | A1 | 8/2007 | Lipman et al. |
| 2007/0266499 | A1 | 11/2007 | O'Keefe et al. |

FOREIGN PATENT DOCUMENTS

| | | | |
|---|---|---|---|
| EP | 1 695 681 | A1 | 8/2006 |
| WO | WO 02/15835 | A1 | 2/2002 |

* cited by examiner

METHOD OF INFLATING, IN ALTERNATING MANNER, A SUPPORT DEVICE HAVING INFLATABLE CELLS, AND A DEVICE FOR IMPLEMENTING THE METHOD

The present application claims priority, under 35 U.S.C. §119(a), of French National Application No. 07 58412 which was filed Oct. 18, 2007 and which is hereby incorporated by reference herein.

BACKGROUND

The present disclosure relates to the field of pressure regulation for support devices having inflatable cells or compartments, such as, for example, therapeutic mattresses. Such mattresses are used in particular for beds for patients suffering from or presenting risks of developing skin pathologies of the decubitus ulcer or "bedsore" type due to them being kept immobile for prolonged periods in a sitting position or in a recumbent position. The present disclosure relates more particularly to a method of inflating, in alternating manner, inflatable cells of such a support device, and to a device for implementing the method.

In a support device having inflatable cells such as a therapeutic mattress, each inflatable cell communicates in substantially leaktight manner with at least one feed means for feeding an inflation fluid (conventionally, air) to the cells, via at least one electrovalve, such as a solenoid valve, that is itself connected to a control device for controlling inflation of the inflatable cells of the mattress and for regulating the air pressures inside said cells.

In practice, in order to fill/inflate the inflatable cells of the support device, air is fed into said cells until the desired pressures are reached. Conversely, in order to empty or deflate the inflatable cells or in order to adjust the inflation pressures, air is removed via a removal orifice provided for that purpose, and which sometimes is also provided with a solenoid valve that is controlled by the control device for controlling inflation.

Support devices of this type are used as mattresses for patient care because they make it possible to provide appropriate positioning of and appropriate support for the body on the surface of the mattress, as a function of the morphology and of the position of the patient.

In principle, ideal patient comfort and optimum blood circulation through the tissue for avoiding bedsore formation or for reducing local pain in certain zones of the body that bear against the mattress are obtained when the bearing points of the body are redistributed over the surface of the mattress, i.e. when the pressure exerted by the various zones of the body on the mattress (which pressure is referred to as the "interface pressure") is substantially identical at all of the points of the surface of the body that are in contact with the mattress and if, in addition, the surface area of the body that is in contact with the mattress is as large as possible. This requires the degree to which the inflatable cells of the mattress are inflated under the various portions of the body to be adapted to control the depth to which the body penetrates into the various zones of the mattress.

For this purpose, the air pressures inside the inflatable cells are distributed by controlling the filling/emptying of said cells as a function, in particular, of measurements of stress exerted by the body of the patient on the mattress, which measurements are taken with sensors in, on, or sometimes below the mattress, depending on the type of sensors implemented. Such sensors are referred to below as "morphology sensors" and are known to the person skilled in the art. They measure, more particularly, a stress consisting in the "interface pressure", i.e. the pressure exerted by the patient's body on the cells of the mattress, or the depth to which the patient's body penetrates into the cells of the mattress or the volume of immersion of the body of the patient into the cells of the mattress, as described, for example, in the Applicant's European Patent EP 0 676 158 and in the Applicant's European Patent EP 1 056 372. From those measurements, computation is used to deduce an appropriate regulation pressure for regulating the inflation of the cells as a function of the morphology of the patient on the mattress. The expression "morphology of the patient on the mattress" is used herein to mean both the mass of the patient and the contact surface area over which the patient is in contact with the mattress, i.e. the position of the patient on the mattress.

Controlling and regulating filling/emptying of the inflatable cells also makes it possible to obtain support devices that operate in an "alternating" inflation mode in which certain cells of the support device that are uniformly distributed along the length thereof are inflated and deflated simultaneously and in alternation. For example, one in every two cells are deflated and re-inflated, and then the cells adjacent to the previously deflated and re-inflated cells are deflated and re-inflated.

Thus, each inflatable cell of the support device is deflated/re-inflated in succession and progressively, thereby creating a sort of wave moving back and forth in the longitudinal direction of said support device and relieving the interface pressure locally, thereby locally facilitating blood circulation through the soft tissue at the interface with the surface of the support device.

In order to achieve such an alternating inflation mode for inflating the cells in alternation, current inflatable-cell support systems have inflation pressure control and regulation systems that incorporate complex electronic circuits for controlling the solenoid valves and inflation compressors and the like, such circuits including, inter alia, digital clocks and counters that have particularly high development and manufacturing costs and that are particularly voluminous. In addition, with currently known control and regulation systems, the alternating inflation and deflation cycle times are fixed, and left to the judgment of the designer or of the user.

The present disclosure relates to a method of inflating, in alternating manner, inflatable cells of a support device for supporting an element to be supported, which device is of the mattress type for supporting the body of a patient, said mattress being made up of cells that are inflatable with a fluid, in particular air, and having at least one zone made up of first and second series of inflatable cells referred to respectively as "first" cells and as "second" cells, the cells of each series communicating fluidly such as pneumatically, with one another and with inflation means, it being possible for the cells of each series of cells to be either in a state in which communication is open with the pump and with the cells of the other series of cells, or in a state in which communication is closed with the pump and with the cells of the other series and is open with the outside, in which state the cells are connected to the surrounding air, in which method alternating deflation and re-inflation cycles are performed during which each of said series of cells is deflated and then re-inflated in alternation and in succession, said first cells being deflated and then re-inflated simultaneously respectively with the re-inflation and with the deflation of said second cells, the alternating deflation and re-inflation steps for deflating and re-inflating, in alternation, said first and second cells of the support device including at least one step of inflating said cells to a value of at least one reference pressure Pc, PRmax, PRmin whose value is determined on the basis of a continuous measurement taken by means of a "morphology" sensor measuring the stress generated by the patient's body on the cells.

In patents EP 1 695 681 and EP 0 168 213, alternating inflation/deflation methods are described. However, in those two patents, the regulation pressure to which the cells are to be inflated is not determined by means of a sensor that directly measures the stress exerted by the body of the patient on the mattress, but rather it is deduced from measurements of pressure inside the cells, which is less reliable and less easy to implement.

More precisely, in Document EP 1 695 681, a predetermined alternating cycle time is set and the inflation pressure is determined as a function of a residual air pressure value measured inside the cells at the end of deflation during the cycle, after a predetermined given set time. Thus, in EP 1 695 681, it is possible to cause the inflation pressure of the cells to vary regularly during the cycle as a function of the morphology of the patient, but it is not possible to cause the inflation/deflation cycle time to vary automatically as a function of the morphology of the patient.

Finally, in EP 1 695 681, the cells are not deflated fully at the end of deflation, which is disadvantageous in terms of how well the blood circulates.

In EP 0 168 213, the regulation pressure or inflation pressure for the cells is determined on the basis of measurements of pressure inside the cells when the pressures in the various cells come to equilibrium during a calibration or initialization step before the alternating cycle proper starts. This calibration step must be repeated at regular intervals. In EP 0 168 213, no indication is given as to the implementation of the alternating inflation/deflation method subsequently to that initial calibration step.

Thus, in EP 1 695 681 and EP 0 168 213, the reference pressures to which the cells are to be inflated during an inflation/deflation cycle are determined as a function of the air pressures inside the cells as measured at regular intervals, which further requires a clock to be implemented.

SUMMARY

A method of inflating, in alternating manner, inflatable cells of a support device such as a therapeutic mattress is provided, and a device for implementing the method that is less expensive than known methods and devices is disclosed herein.

According to this disclosure, the method of inflating, in alternating manner, cells of a therapeutic mattress whose inflation/deflation cycle time is a function of the morphology and of the position of the patient on the mattress is provided.

According to an aspect of this disclosure, a method of inflating, in alternating manner, inflatable cells of a support device for supporting an element to be supported is provided, which device is of the mattress type for supporting the body of a patient, said mattress being made up of cells that are inflatable with a fluid, in particular air, and having at least one zone made up of first and second series of inflatable cells referred to respectively as "first" cells and as "second" cells, the cells of each series communicating fluidly such as pneumatically with one another and with inflation means, it being possible for the cells of each series of cells to be either in a state in which communication is open with the pump and with the cells of the other series of cells, or in a state in which communication is closed with the pump and with the cells of the other series and is open with the outside, in which state the cells are connected to the surrounding air, in which method alternating deflation and re-inflation cycles are performed during which each of said series of cells is deflated and then re-inflated in alternation and in succession, said first cells being deflated and then re-inflated simultaneously respectively with the re-inflation and with the deflation of said second cells, the alternating deflation and re-inflation steps for deflating and re-inflating, in alternation, said first and second cells of the support device including at least one step of inflating said cells to a value of at least one reference pressure Pc, PRmax, PRmin whose value is determined on the basis of a substantially continuous measurement taken by means of a "morphology" sensor measuring the stress generated by the patient's body on the cells, wherein the alternating deflation and re-inflation steps for deflating and re-inflating, in alternation, said first and second cells take place in a cycle controlled by said inflation means being switched on or off, which switching on or off is controlled as a function of the values of the pressures of the fluid measured inside said cells and of comparison of said values with a said reference pressure value, and said inflation means being switched on or off causes said first or second cells to be put into the state in which communication is open with said inflation means or into the state in which communication is closed therewith.

The method disclosed herein thus involves implementing two measurements and comparing them, namely substantially continuously measuring the internal pressures of the cells during the cycle and comparing the measured pressures with a reference pressure that is computed on the basis of the measurements taken substantially continuously by a morphology sensor.

Thus, it is possible to control the cycle without implementing a clock in order to cause the inflation means to be switched on or off, and in order to cause communication to be opened or closed between the cells and the inflation means.

In addition, in accordance with the present disclosure, the cycle time is adjusted automatically and substantially continuously as a function of said reference pressure value as measured by means of said morphology sensor, and thus as a function of the morphology of the patient on the mattress.

Finally, it is possible to proceed to the next step in the cycle only if the inflation means have succeeded, during the inflation, in re-establishing the pressure in the cells to a reference pressure value. This constitutes safety means because the cycle is necessarily interrupted in the event of leakage, unlike in prior methods in which clocks cause the successive steps of the cycle to be triggered, even in the event of leakage.

More particularly, in the method disclosed herein: said inflation means are switched on or off as a function of the values of the pressures of the fluid measured in said cells and of comparison of said values with a value of a first reference pressure or "regulation pressure" that is determined as a function of the morphology of the patient, and with a value of a second reference pressure or "setpoint pressure" that is greater than said regulation pressure and that is computed relative to said regulation pressure; and said inflation means being switched on or off controlling which of said first and said second reference pressures is chosen to be taken into account for said comparison for the next switching on or off of the inflation means during a said cycle.

Yet more particularly, in the method disclosed herein:

said first cells are connected one after another in series;

said second cells are connected one after another in series;

the following successive steps are performed, in which:

a) when (t2) all of the cells of the first and second series are inflated to a pressure corresponding to a said regulation pressure Pr, the pump being off, and the cells of each series of cells being in the state in which communication is open with the pump and with the cells of the other said series of cells, detection of said regulation pressure in said first and second cells, causes:

a-1) said first cells to deflate by being connected to the surrounding air; and a-2) said second cells to be over-inflated by switching the pump on until a determined setpoint pressure Pc is reached that is greater than the regulation pressure; and b) when (t3) the setpoint pressure is reached in said second cells, detection of said setpoint pressure in said second cells causes the pump to be switched off and each series of cells to be put into the state in which communication is open with the pump and with the cells of the other series of cells, thereby making it possible for fluid to be transferred from said second cells to said first cells, and thus for said second cells to be deflated, and, simultaneously, for said first cells to be re-inflated, to said regulation pressure; and c) when (t5) all of said first and second cells are at a pressure corresponding to said regulation pressure, detection of a said regulation pressure in said cells causes the pump to be switched off, which switching off of the pump causes:

c-1) said second cells to be deflated by being connected to the surrounding air; and c-2) said first cells to be over-inflated by switching the pump on until a said setpoint pressure (Pc) is reached; and d) when (t6) said setpoint pressure is reached in said first cells, detection of said setpoint pressure in said first cells causes the pump to be switched off and each series of cells to be put into the state in which communication is open with the pump and with the cells of the other series of cells, thereby making it possible for fluid to be transferred from said first cells to said second cells, and thus for said first cells to be deflated, and, simultaneously, for said second cells to be inflated, to said regulation pressure; and e) where applicable, the cycle of steps a) to d) is reiterated.

In steps a-1) and c-1), deflation respectively of said first cells and of said second cells corresponds to said cells being partially emptied. In practice, only in the range of about 15% to about 20% of the fluid contained in said cells is transferred. However, in view of the pressure exerted on the body of the patient, the cells that deflate by being connected to the discharge deflate faster than the cells that are being inflated. This makes it possible to reach a relative pressure of zero relative to atmospheric pressure during deflation.

The times of the "balancing" stages of the steps b) and d) and of the over-inflation/deflation stage of the steps a) and c) are determined by the time taken by the inflation means to reach the regulation or setpoint pressures determined by the mass of the element to be supported that is resting on the support device.

One way the method disclosed herein differs from the state of the art is by its variable cycle time that is adjusted automatically as a function of the morphology of the patient. It thus offers higher performance than known inflation regulation devices because it enables the additional therapeutic variable of cycle time to be parameterized automatically.

Inflation time varies as a function of the patient. Thus, for a relatively lightweight patient, the volume of immersion of the body into the mattress is relatively small and the cells are re-inflated faster.

This characteristic of substantially continuous self-regulation of the cycle time as a function of the weight of the patient using the method of the present disclosure is very desirable because patients of slight build present higher risks of bedsores forming and require faster massaging than patients of heavier build.

The method disclosed herein is also less expensive than known methods because it does not require implementation of a costly electronic clock for sequencing the successive stages of switching on and switching off the pump.

More particularly, the support device is a mattress made up of a plurality of cells filled with air, in the form of sausage-shaped tubes disposed transversely to the longitudinal direction of the mattress, and the inflation means comprises a pump including an air compressor.

Finally, implementation of the support device is made safer because it is dependent on the capability of the therapeutic mattress to support properly the patient recumbent on the mattress. The deflation/re-inflation stage time of steps a) and c) can vary depending on the structural integrity of the cells of the support device, it being possible for the variation to go as far as to block the cycle and to generate a malfunction alarm, if a leak of the inflation fluid from the cells or from the fluidic connection means between the cells and the inflation means is greater than the maximum flow rate of the inflation device. In which case, the inflation system is never switched off, and so the cycle does not go on to the next stage.

Thus, in the event of leakage, the method disclosed herein is interrupted, but the leaking cells continue to be inflated so that there is no risk of sudden deflation which could be undesirable for the patient.

According to a one characteristic of the method disclosed herein, the "setpoint" fluid pressure is determined relative to the regulation pressure, in particular to be proportional to the regulation pressure, such as to be greater by at least 10% than the "regulation" pressure, and even greater by at least in the range of about 15% to about 30% than said "regulation" pressure in some embodiments.

In one implementation of the method disclosed herein:

said first cells are connected to at least a first solenoid valve making it possible either to establish communication that is open with the pump and with said second cells when the solenoid valve is in a "rest" state, or to connect said first cells to the surrounding air by putting them in the state in which communication is closed with the pump and with said second cells and in which communication is open with the outside, when the solenoid valve is in an "activation" state;

said second cells are connected to at least a second solenoid valve making it possible either to establish communication that is open with the pump and with said first cells when the solenoid valve is in a rest state, or to connect said second cells to the surrounding air by putting them in the state in which communication is closed with the pump and with said first cells and in which communication is open with the outside, when the solenoid valve is in an activation state; and the pump being switched off causing said first and second solenoid valves to be put into the activation or the rest states.

More particularly, the pump being switched off causes the following changes of state:

in steps a) and c), the pump being switched off causes said first solenoid valve and, respectively, said second solenoid valve to be put into the activation state; and in steps b) and d) the pump being switched off causes said second and said first solenoid valves to be put into the rest position.

Said solenoid valves are 3-port solenoid valves, and in some embodiments, in-line 3/2 solenoid valves.

This implementation requires 3-port solenoid valves or "3/2 solenoid valves" to be implemented.

Each of said 3-port solenoid valves has:

a first internal channel suitable for co-operating with an open orifice for feeding air to said cell and for removing air therefrom;

a second internal channel suitable for communicating with a pipe for feeding the solenoid valve and said cell with fluid; and a third internal channel opening out to the surrounding air, making it possible to remove fluid from said cell, said second channel being closed off.

In some embodiments, each of said solenoid valves has "first" and "second" end-pieces disposed symmetrically about a main body defining an outside surface of rounded shape, said main body typically being of cylindrical shape, said main body having the same longitudinal axis as said first and second end-pieces.

In some embodiments, the outside diameter of said body of cylindrical shape is substantially identical to or slightly greater than the outside diameter of the feed pipe. Thus, the solenoid valve can be disposed in alignment with the pipe, with improves compactness.

In one contemplated implementation, the regulation pressure corresponds to a pressure lying in a "regulation" range PRmax to PRmin. This makes it possible to avoid over-sensitivity that could give rise to undesired interferences with cycles, in particular, to variations in cycle times, for the same patient because the regulation pressure can vary as a function of the patient's movements on the mattress, inter alia. In which case, the setpoint pressure is greater than PRmax.

According to one characteristic of the method of the present disclosure:

in steps b) and d), during said transfer, when the maximum regulation pressure PRmax is detected respectively in said second cells and in said first cells even though the minimum regulation pressure PRmin is not reached respectively in said first cells and in said second cells, the pump is caused to be switched on for inflating said first cells and said second cells, respectively; and in steps a) and c), the pump is caused to be switched off by detection of a pressure in said first and second cells that lies in said regulation range, and the pump is switched back on in steps a-2) and c-2) by detection of a pressure in said cells that is less than the setpoint pressure.

It can be understood that, under certain circumstances, in steps b) and d), the flow rate of fluid transferred between the two series of cells is insufficient to enable the minimum value of the regulation pressure range to be reached in said cells and/or to maintain the pressure in said first and second cells as connected together within said regulation range because, in view of the pressure exerted by the body of the patient on the cells being deflated, the cells that are deflating deflate faster than the cells that are being re-inflated inflate. The pump being switched on slows down the deflation of the cells being deflated and enables the cells being re-inflated to reach the regulation pressure.

Also in some embodiments, said mattress includes at least one zone in which each of said two series of cells comprises the same number of cells, with the successive cells belonging to one series and then to the other in alternation in the longitudinal direction of the mattress-type device in said zone. In other words, a cell of each of the two series of cells is adjacent to a cell of the other series of cells, i.e. preceded and/or followed by a cell of the other series of cells.

It can thus be understood that, during each deflation and re-inflation cycle, one in every two cells of the support device are deflated and re-inflated in alternation.

Optionally, the mattress includes at least a third series of cells or "third" cells in communication with said pump and with said first and second cells, said third cells communicating fluidly and substantially continuously with one another, and said third cells are interposed fluidly between the pump and said first and second cells, so that the pressure in said third cells varies between the regulation pressure and the setpoint pressure during steps a) to d).

More particularly, said third cells are interposed upstream from said first and second solenoid valves.

In accordance with the present disclosure, it is possible to implement a pump of relatively lower flow-rate, and thus of lower cost, than pumps controlled by a clock as in the prior art because, in the prior art, the pumps are calibrated as a function of the time required for bringing the mattress into service, i.e. the time required for initially inflating the mattress, whereas, in some embodiments contemplated herein, the pump is calibrated solely as a function of the volume of the cells of each of said first and second series that is to be re-inflated from P=0 to Pc, which volume is less than one half of the total volume.

More particularly, in some embodiments, the flow-rate of the pump is chosen as a function of the volume of said first and second cells so as to obtain a cycle time of in the range of about 5 minutes to about 20 minutes for patients weighing in the range of about 50 kilograms (kg) to about 120 kg.

Implementation of said third cells makes it possible to constitute a fluid reserve that supplements the volume of fluid transferred in steps b) and d), thereby making it possible to implement a pump of lower flow-rate.

In some embodiments, the number of said first and second cells is less than one half of the total number of cells in the mattress, and preferably in the range ⅓ of the total number of cells to ½ of said total number of cells.

In one embodiment, said zone of the first and second cells covers the zone of the sacrum, and the mattress includes third cells at the foot zone and at the head zone. Even more particularly, there are four of said first cells and four of said second cells, i.e. eight in all, in said zone, and the mattress is made up of twenty cells, including three in the foot zone and seven in the head zone.

In order to implement the above-presented method, an inflation device for inflating a support device for supporting a patient to be supported, in particular a mattress or a cushion for supporting the body of a patient, is provided, said mattress being made up of cells that are inflatable with a fluid, in particular air, said inflation device comprising:

said inflation means;

fluidic communication means connecting said inflation means to said inflatable cells;

said morphology sensor suitable for measuring the stress applied by a said patient on said inflatable cells of the support device and for determining said reference pressure value, said sensor being connected to control means for controlling the inflation means;

pressure measurement means for measuring the pressures inside said inflatable cells; and control means for controlling said inflation means;

wherein said control means for controlling said inflation means are connected to said pressure measurement means and are suitable for causing said inflation means to be switched on or off as a function of the value of the pressure of the fluid that is measured in said cells by said pressure measurement means by comparing said value with at least one said reference pressure value determined by means of a morphology sensor.

In some embodiments, the device of the present disclosure further comprises a morphology sensor suitable for measuring the interface pressure applied by a said patient on said inflatable cells of the support device and for determining said regulation pressure value and said setpoint pressure value, said sensor being connected to said control means for controlling the inflation means.

The morphology sensor makes it possible to determine and to quantify the interface pressure exerted by the patient on the cells, resulting from the mass of the element to be supported by the cells of a support device, which interface pressure causes fluid to be displaced and the element to be supported to penetrate into the cells, thereby causing an increase in fluid pressure in the cells. Morphology sensor devices are known to the person skilled in the art, as mentioned above, but said morphology sensor may comprise at least one Force Sensing Resistor (FSR).

The pressure measurement means for measuring pressure inside the cells can, for example, be piezoelectric sensors.

More particularly, the device of the present disclosure further comprises:

said first and second solenoid valves connected to respective ones of said first and second cells and to said inflation means, said solenoid valves being suitable for making it possible either to establish communication that is open with the pump and with said second cells and, respectively, with said first cells when the corresponding solenoid valve is in a said rest state, or to connect said first cells and, respectively, said second cells to the surrounding air by putting them in the state in which communication is closed with the pump and with said second cells and, respectively, said first cells and in which communication is open with the outside, when the corresponding solenoid valve is in a said activation state; and means for detecting when the pump is off, which means are connected to a sequencer suitable for causing said solenoid valves to be put into the activation state or into the rest state in succession, and for causing said reference pressures to be chosen in a determined sequence.

According to another characteristic of the inflation device of the present disclosure, said inflation means comprise a low-voltage pump powered under a voltage of 12 volts AC.

Optionally, the inflation device further comprises a power supply including a transistor bridge, in order to generate the AC voltage for said inflation means. In addition, the inflation device further comprises a morphology sensor suitable for measuring the stress applied by a said element to be supported on said inflatable cells of the support device, and a pressure sensor suitable for measuring pressure inside said inflatable cells.

Also according to the present disclosure, the inflation device of some embodiments further comprises a power supply battery suitable for enabling the inflation device to continue to operate in the event that the mains power supply is interrupted.

BRIEF DESCRIPTION OF THE DRAWINGS

Other characteristics and advantages of the inflation method and of the inflation device of the present disclosure appear from the following detailed description, given by way of illustration that is non-limiting to the scope of the invention, and with reference to the accompanying drawings, in which.

DETAILED DESCRIPTION

In the curves of FIGS. 3 to 7, the pressures up the y-axis are given in inches of water (1 inch of water (inch $H_2O$)=254 pascals (Pa)=2.19 millimeters of mercury (mm Hg)) and time along the x-axis is in seconds.

Figure 1A:
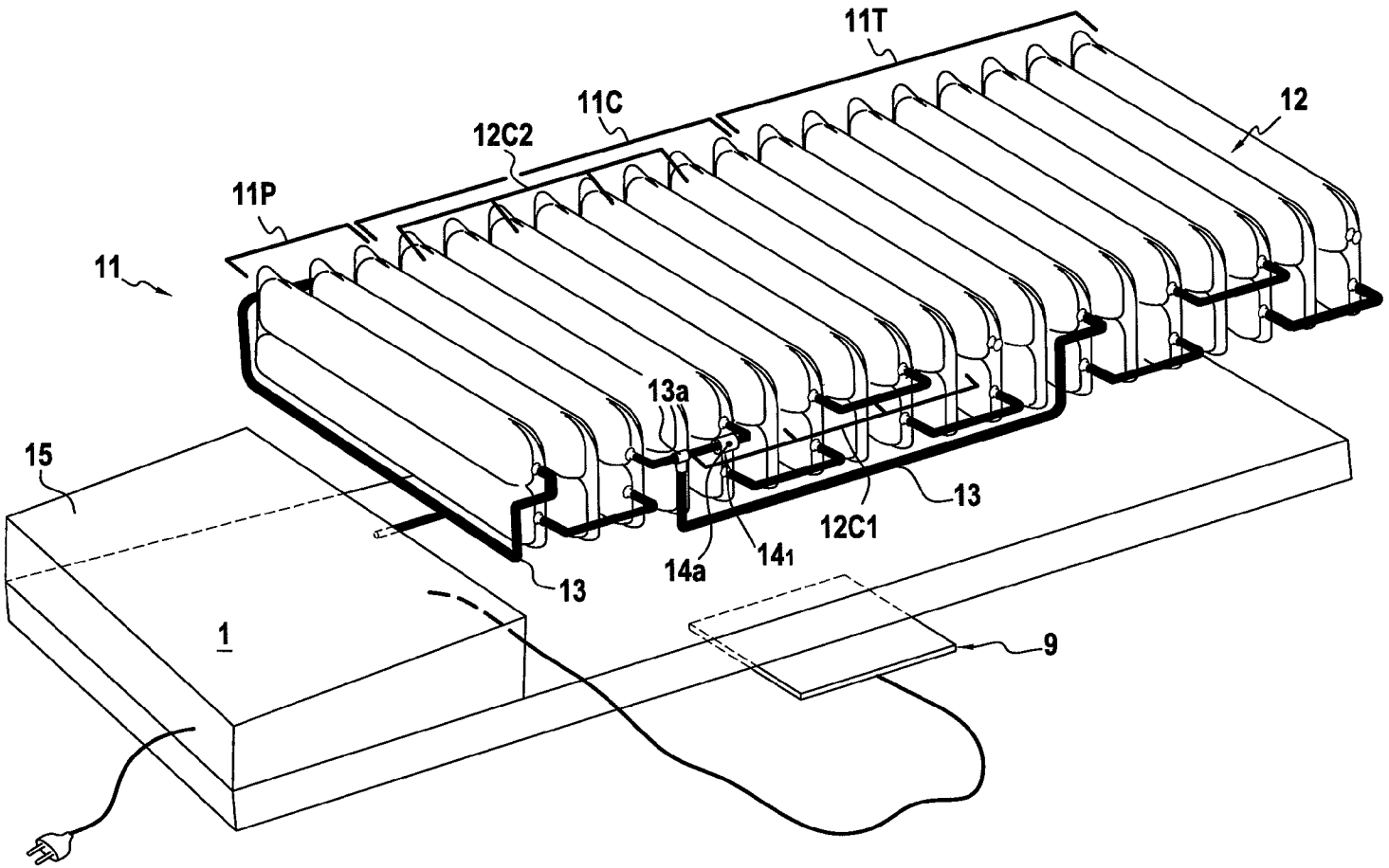
FIGS. 1A and 1B show a support device having inflatable cells that incorporates an alternating inflation device for implementing the alternating inflation method of the present disclosure.
Figure 1B:
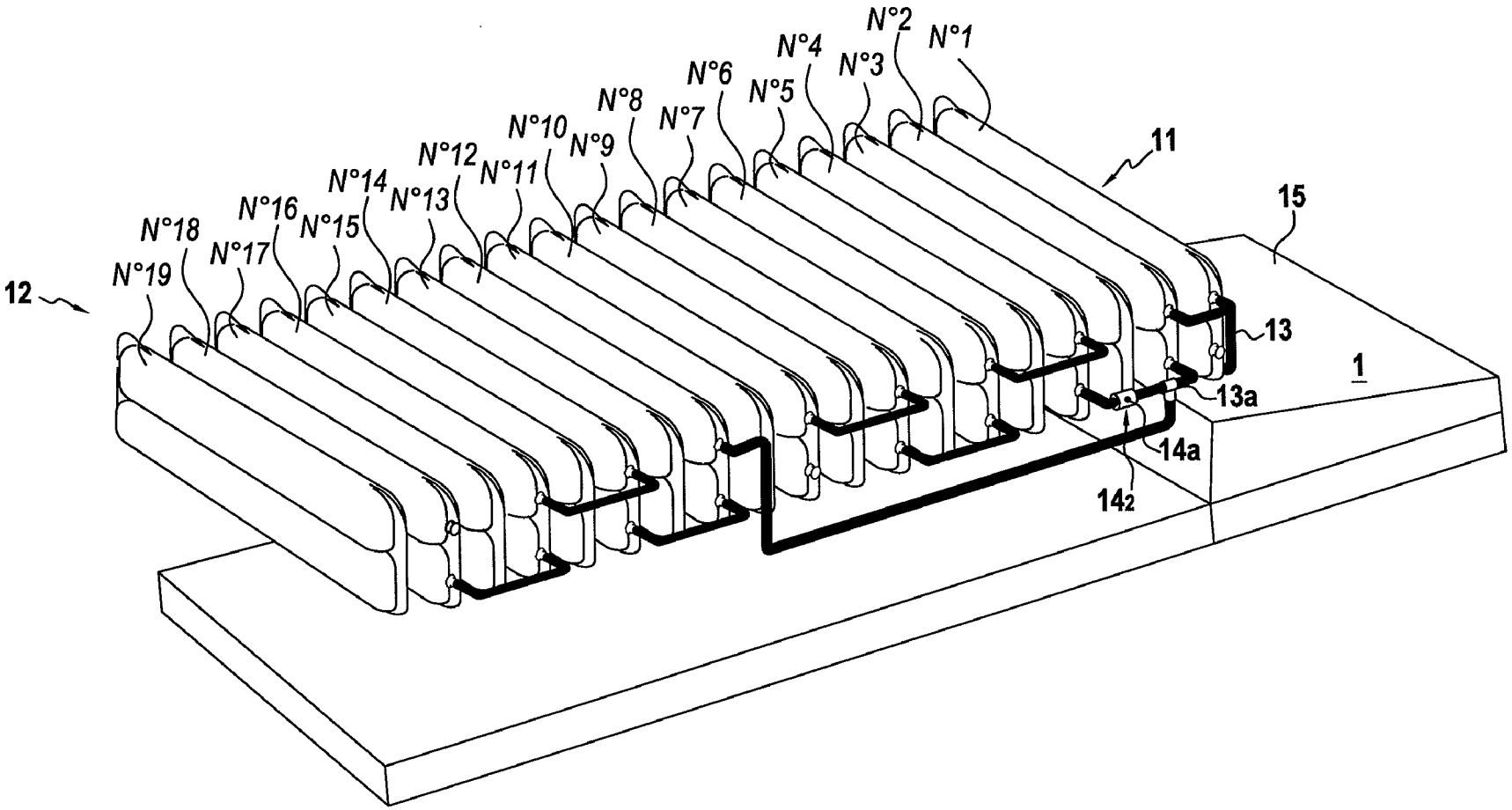

FIGS. 1A and 1B show a therapeutic mattress 11 equipped with an inflation device 1 according to the present disclosure.

The therapeutic mattress 11 is made up of 19 inflatable cells, said cells 12 being disposed transversely to the longitudinal direction of the mattress. Each cell is made up of two compartments, namely an upper compartment and a lower compartment, said upper and lower compartments being in the form of sausage-shaped tubes and communicating with each other at their ends.

The mattress 11 shown in FIGS. 1A and 1B comprises the following three zones:

a foot zone 11P made up of the first three cells (cells Nos. 1 to 3);

a central zone 11C made up of eight cells (cells Nos. 4 to 11); and a head zone 11T also made up of eight cells (cells Nos. 12 to 19).

The central zone 11C corresponds to a zone inflated using an alternating inflation method of the present disclosure.

The central zone 11C comprises a first series of cells or "first cells" 12C1 (cells Nos. 5, 7, 9 and 11) and a second series of cells or "second cells" 12C2 (cells Nos. 4, 6, 8 and 10).

The cells of each of said first and second series 12C1 and 12C2 are connected in series, i.e. in line, the two series being connected in parallel, fed by the same inflation device 1.

More precisely, each of the cells 12 of the mattress 11 is provided with an inlet orifice (not shown) and with an outlet orifice (not shown). The inlet or feed orifice is situated at one end of the upper compartment, in the transverse direction of the mattress, the outlet or removal orifice being situated at the same-side end of the lower compartment, in the transverse direction of the mattress (or in the longitudinal direction of the cell). Two adjacent cells have their orifices disposed at opposite ends in the transverse direction of the mattress and they belong to different series of cells.

Thus, in FIG. 1A, it can be seen that cell No. 1 at the foot of the mattress is fed via a pipe 13 at the end of the upper compartment of cell No. 1, and the end of the same side of the lower compartment of cell No. 1 communicates directly with the same-side end of the lower compartment of cell No. 3, whose same-side end of the upper compartment communicates, starting from a T-branch fitting 13*a*, firstly with a first solenoid valve $\mathbf{14}_1$, starting from which cells Nos. 5, 7, 9, and 11 of said first series 12C1 of cells are disposed in series, and secondly, connected in parallel with the cells 12C1, with the same-side end of the upper compartment of cell No. 13, which is the second cell of the head zone 11T starting from the foot of the bed, the other cells of the head zone Nos. 15, 17, and 19 being connected one after another in series.

Symmetrically, in FIG. 1B, it is shown that cell No. 2 of the foot zone 11P is fed, at the opposite end of the upper compartment, from the device 1, via the same pipe 13. And the same-side end of the lower compartment of cell No. 2 of the foot zone 11P feeds a T-branch fitting 13*a*, from which the following are fed in parallel:

firstly the second solenoid valve $14_2$, from which cell No. 4 of the mattress, representing the first cell of said second series of cells 12C2, is fed, the other cells of the second series of cells 12C2, namely cells Nos. 6, 8, and 10, being fed in series, i.e. communicating with one another in series symmetrically and parallel to said first series of cells 12C1; and secondly a pipe 13 that feeds the end of the upper compartment of the first cell No. 12 of the head zone, the same-side end of the lower compartment of the following second cell of the head zone, namely cell No. 14 starting from the foot of the bed, being fed from the same-side end of the lower compartment of cell No. 12, and so on, in series on to cell No. 16 and then on to the penultimate cell No. 18 of the head zone 11T.

It can thus be seen that the cells of the head zone 11T and of the foot zone 11P constitute third cells that are situated upstream of the first and second solenoid valves $14_1$ and $14_2$.

The solenoid valves $14_1$ and $14_2$ are shown disposed in line between the pipes 13 and the orifices of the first cells of said first series 12C1 and of said second series of cells 12C2. However, they could be disposed in specific housings.

Said first and second solenoid valves $14_1$ and $14_2$ are 3-port solenoid valves of the 3/2 type, as described above. Side orifices 14*a* for communicating with the surrounding air are shown on the solenoid valves $14_1$ and $14_2$. They are caused to change states between their activation states and their rest states by the transistors $6_1$, and $6_2$ of the sequencer 6 described below.

When a solenoid valve is in the activation state, only the side orifice for communicating with the surrounding air is open. When a solenoid valve is in the rest state, the side orifice for communicating with the surrounding air is closed and the other two orifices are open, which other two orifices communicate respectively with the pump and with the first cell of the series of cells concerned by said solenoid valve.

More particularly, each of said solenoid valves comprises a main body having a cylindrical internal cavity into which the two said first and second internal channels, open out, said internal cavity enclosing a longitudinal magnetic core suitable for being moved in said axial longitudinal direction of said solenoid valve, said magnetic core moving inside an induction coil that extends axially, it being possible for said core to move between firstly an opening position in which the core does not obstruct the ends of said first and second internal channels opening out into said internal cavity so as to allow the fluid to flow through said solenoid valve between the ends of said first and second end-pieces and, secondly a closure position in which said core obstructs that end of one said first and second internal channels of the solenoid valve that opens out into said internal cavity so as to prevent the fluid from flowing through said solenoid valve between the ends of said first and second end-pieces.

This type of solenoid valve is referred to as an "in-line compact solenoid valve" because the various component elements are disposed along the same axis as the longitudinal axis of the solenoid valve.

In addition, the fluid flowing through the solenoid valve between its first and second end-pieces, in the illustrative embodiment, always flows therethrough axially along the same longitudinal axis as the longitudinal axis of the solenoid valve, unlike with conventional three-port valves in which the axis of the core and the movement of the core are, in general, perpendicular to a duct through which the fluid flows inside the solenoid valve.

"In-line compact" solenoid valves of this type are described in the Applicant's French Patent Application FR 0701391, the U.S. counterpart of which is U.S. patent application Ser. No. 12/036,582.

This organization of the various cells 12 of the mattress in two series of cells 12C1 and 12C2 that are connected in parallel but that are disposed such that the cells of said first series 12C1 and of said second series 12C2 succeed one another in alternation, and with the two series being controlled by different solenoid valves, makes it possible to facilitate implementation of the alternating inflation method described herein, while minimizing the space occupied around the mattress by the network of pipes and other means for establishing fluidic communication between the cells.

Figure 3:
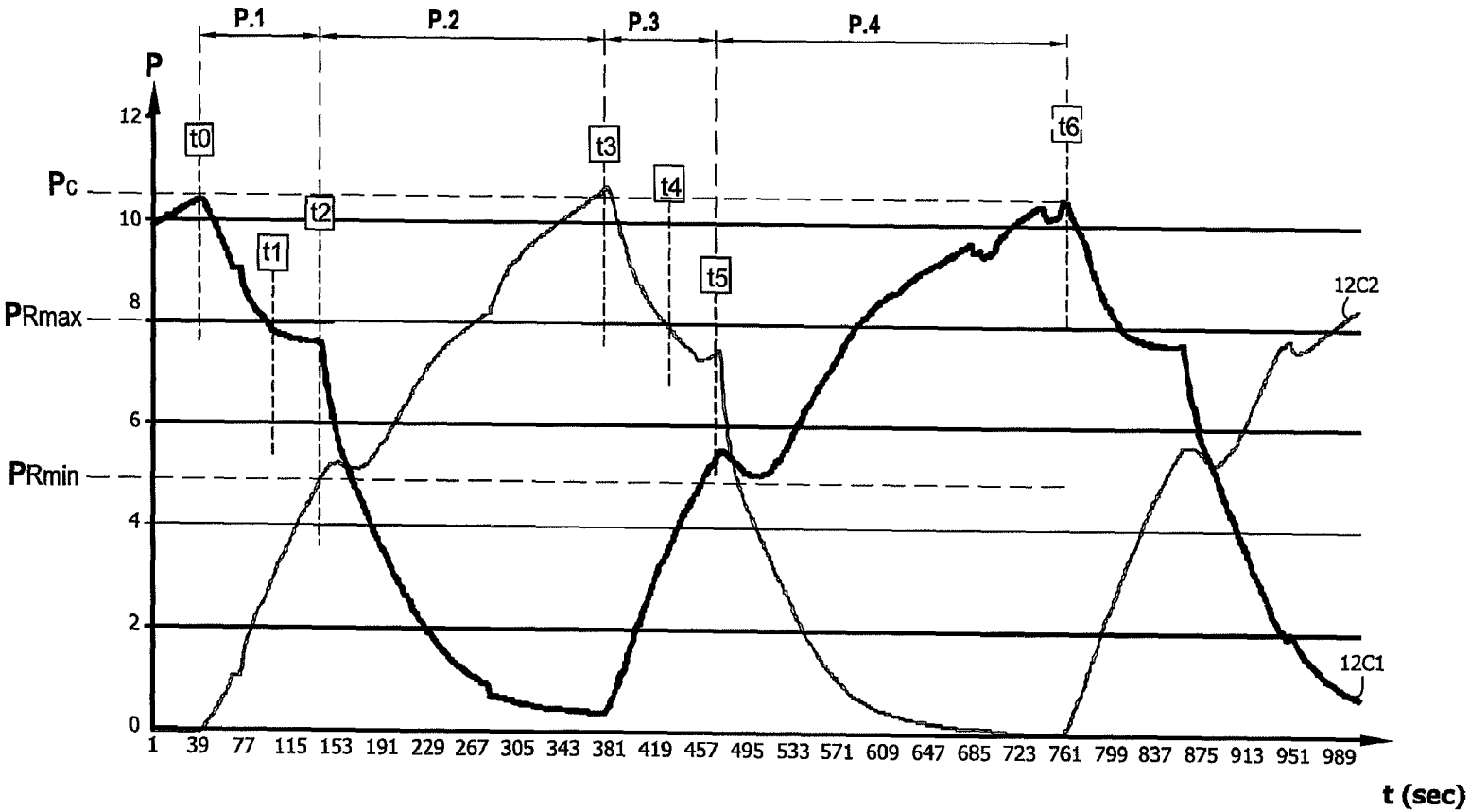
FIG. 3 shows curves of pressure variations in an inflatable support device operating using the alternating inflation method of the disclosure.

FIG. 3 shows graphs of pressure as a function of time, in cells 12C1 and 12C2, during the various stages described below of the alternating inflation cycles for inflating the cells 12C1 and 12C2.

Before t0, said first cells 12C1 are in the re-inflation stage, said first solenoid valve $14_1$ being in said rest state, enabling said cells 12C1 to be fed via the pipe 13 from the inflation device 1. Simultaneously with the re-inflation of the first cells 12C1, the second cells 12C2 are in the deflation stage and, as shown in FIG. 3, they have reached a relative pressure value of zero. In this stage before t0, the second solenoid valve $14_2$ is in the activation state.

At t0, the pressure detected inside the first cells 12C1 reaches the setpoint pressure Pc determined as being greater by about 20% than the upper limit PRmax of the regulation range. This detection of a pressure Pc in said cells 12C1 causes the pump to be switched off. And the pump being switched off triggers the next stage (stage P.1) in which the second solenoid valve $14_2$ is put into the rest state. Thus, as from t0, in stage P.1, the first and second solenoid valves $14_1$ and $14_2$ are in the rest state, and the pump is off. And phase P.1 is a stage in which balancing takes place by air being transferred from said first cells 12C1 towards the second cells 12C2, during which stage the pressure in cells 12C1 decreases and the pressure in cells 12C2 increases merely by air being transferred under the effect of the patient bearing against them.

At t1, the pressure measurement means 3 for measuring the pressures in the cells measure a pressure in the first cells 12C1 that is equal to the upper limit PRmax of the regulation range, while, simultaneously, the pressure in the second cells 12C2 is less than the lower limit PRmin of the regulation range. These pressure conditions in the first and second cells 12C1 and 12C2 cause the pump to be switched back on, without there being any change in position of the first and second solenoid valves $14_1$ and $14_2$.

At t2, the pressure in said second cells 12C2 reaches the lower limit PRmin and the first and second cells 12C1 and 12C2 are maintained at a pressure lying within the regulation range, thereby causing the pump to be switched back off again and sending a signal to the sequencer 6 to trigger the next stage (stage P.2), in which the first solenoid valve $14_1$ is activated to connect the cells 12C1 to the surrounding air, thereby enabling the first cells 12C1 to deflate, while the second solenoid valve $14_2$ remains in the rest position. Activation of the first solenoid valve is accompanied by a return $6_3$ of information to the comparator of the control means 4, instructing the comparator to take the setpoint pressure as the reference pressure for inflating the cells 12C2. This causes the pump to be switched back on and to operate for re-inflating said second cells so long as the pressure detected in the cells has not reached the setpoint pressure.

At t3, the setpoint pressure PC is reached in said second cells, thereby causing the pump to be switched off. The pump being switched off again triggers the next stage (stage P.3), with the second solenoid valve $14_2$ being put into the activation state and the second cells 12C2 being deflated, and thus the second cells being connected to the surrounding air. Activation of the second solenoid valve $14_2$ is accompanied by a return of information to the comparator of the control means 4, which comparator compares the pressure measured in the cells with the regulation pressure range.

At t4, detection of the maximum regulation pressure PRmax in said second cells 12C2, while the pressure in the first cells 12C1 is less than PRmin, i.e. outside the regulation range, causes the pump to be switched on, without said first and second solenoid valves $14_1$ and $14_2$ changing state. This causes the deflation of the second cells 12C2 to slow down, and enables the first cells 12C1 to reach the regulation range at t5.

At t5, when the pressures lie within the regulation range in the first and second cells 12C1 and 12C2, this causes the pump to be switched off. The pump being switched off causes another stage of the cycle to be activated (stage P.4) with the second solenoid valve $14_2$ being activated and the second cells 12C2 being connected to the surrounding air. The second solenoid valve $14_2$ being activated again sends a signal to the control means of the pump to change reference pressure by now comparing the pressure in the first cells with the setpoint pressure. This causes the pump to be switched back on so as to re-inflate said first cells, until the setpoint pressure is reached in said first cells.

At t6, when the setpoint pressure is reached in said first cells, detection of the setpoint pressure in said first cells causes the pump to be switched off and another stage of the cycle to begin by putting said second solenoid valve $14_2$ in the rest state, the two solenoid valves $14_1$ and $14_2$ being at rest, thereby making it possible, as at time t0, to start another balancing stage in which balancing takes place by transfer of air from the first cells 12C1 to the second cells 12C2.

At t0, t3 and t6, said second solenoid valves $14_2$ being put into the rest state at t0 and t6 and said first solenoid valves $14_1$ being put into the rest state at t3 sends a signal to the control means 4 of the pump to compare the pressure inside the cells with the regulation pressure, and, in this example, with a range of values PRmax-PRmin, as a reference pressure range. That is why, when the comparator of the control means 4 establishes that the first cells at t1 and t2 and the second cells at t4 and t5 lie within the regulation range, while the second cells and the first cells do not lie within the regulation range at t1 and, respectively, at t4, said comparator causes the pump to be switched back on at t1 and t4, and it causes the pump to be switched off at t2 and t5 for the opposite reasons, namely that the second cells 12C2 and the first cells 12C1 lie within the regulation range at t2, and, respectively, at t5.

In the example shown in FIG. 1, the central support zone 11C of the mattress 11 is thus made up of eight inflatable cells 12C. These eight cells are organized into two groups of four cells 12C1, 12C2 distributed one in every two cells in the zone 11C and connected to one another fluidly via pipes 13 and to the inflation device 1. During the alternating inflation cycles, the cells of the first group 12C1 are thus inflated while the cells 12C2 of the second group are being deflated and then, conversely, the cells 12C1 are deflated while the cells 12C2 are being inflated.

The inflation device 1 is, in the illustrative embodiment, received in an integrated foot zone or closed compartment 15, in particular covered with foam, of a support device 11 such as a therapeutic mattress having inflatable cells 12 as shown in FIG. 1. However, the inflation device 1 can also be of the ambulatory type and be integrated into an accessory and removable unit of such a support device.

The inflation device 1 (FIG. 1) of the present disclosure firstly includes inflation means constituted by an air-compressor pump 2.

With reference, once again, to FIG. 2, the inflation device 1 also includes sensors 3 for sensing the pressures inside the inflatable cells 12 of the support device 11, in particular a low-pressure sensor, and control means 4. The pressure regulation for regulating the pressures in the cells 12 is implemented with a comparator element for comparing the pressures in the inflatable cells as measured by the pressure sensors 3 with the measurement of the morphology sensor 9. If the pressure measured by the sensors 3 inside the cells is too high relative to the comparative reference pressure deduced from the measurements taken by the morphology sensor 9, the means for deflating the mattress are caused to operate. Conversely, if the pressure in the cells 12 is too low, the inflation means 2 are caused to operate, which inflation means are connected electrically to the control means 4 and to the detection means 5 for detecting that inflation has stopped.

In accordance with the present disclosure, the inflation device 1 includes detection means 5 connected to the inflation means 2 for the purpose of detecting when the inflation means 2 are switched off. Said detection means 5 essentially comprise a single inverter logic gate converting "off" information indicating that the inflation means 2 are off into a signal for an alternating cycle sequencer 6 for sequencing the alternating cycle of changes of state of the solenoid valves and of change of reference pressures of the comparator element of the control means 4 for alternately re-inflating and deflating the inflatable cells of the support device, and said detection means are suitable for controlling said control means.

The sequencer 6 controls the four stages of the alternating cycle that are described above under the control of the inflation-off detection means 5.

At t0, stage No. 1 (P.1): the transistor $6_2$ sends a signal that causes the solenoid valve $14_2$ to be put into the rest state, and a signal is returned $6_3$ to the comparator 4 to take the regulation pressure as a reference for switching the pump on.

At t2, stage No. 2 (P.2): the transistor $6_1$ sends a signal that causes the solenoid valve $14_1$ to be put into the activation state, and a signal is returned $6_3$ to the comparator 4 to take the setpoint pressure as a reference for switching the pump on.

At t3, stage No. 3 (P.3): the transistor $6_2$ sends a signal that causes the solenoid valve $14_1$ to be put into the rest state, and a signal is returned $6_3$ to the comparator 4 to take the regulation pressure as a reference for switching the pump on.

At t5, stage No. 4 (P.4): the transistor $6_1$ sends a signal that causes the solenoid valve $14_2$ to be put into the activation state, and a signal is returned $6_3$ to the comparator 4 to take the setpoint pressure as a reference for switching the pump on.

Said sequencer is connected to the control circuit for controlling the two solenoid valves for emptying and filling the two series of cells and to the control means for controlling the inflation system 4 for switching over the regulation from the "regulation" pressure during the first and third stages to the "setpoint" pressure during the second and fourth stages.

In one embodiment contemplated herein, the inflation means of the device includes a low-voltage pump 2 powered under a voltage of 12 volts AC, generated from a 12-volt DC power supply.

Additionally, the power supply 7 can also include a power supply battery 10 suitable for maintaining operation of the inflation device in the event that the mains power supply is interrupted. Such a battery 10 can, in particular, be useful while transporting a bed-bound patient on a support device having inflatable cells. During such transport stages, the power supply of the electronic inflation device 1 must be disconnected from the electricity mains, and such a battery then makes it possible to maintain the alternating inflation method for alternately inflating the cells 12 of the support device 11 during the transport. Such a power supply battery can, in particular, be of the Lithium-ion type in order to be compact while also offering storage capacity that is sufficient to allow the inflation device to be powered in stand-alone manner for at least two hours.

In order to deliver an AC power supply voltage to the inflation device from a DC voltage, the illustrative device disclosed herein includes a power supply 7 having an "H" bridge of transistors 8. This transistor bridge is controlled by an adjustable-frequency oscillator. It is the frequency of the oscillator 16 that sets the frequency of the AC voltage of the inflation system. This power supply mode is desirable because it makes it possible to optimize the operating point of the inflation system and the efficiency thereof. The performance of the inflation system is thus improved by in the range of about 10% to about 20% with low electrical energy consumption.

The illustrative inflation device of the present disclosure finally, in one embodiment, includes a morphology sensor 9 that is placed under the mattress 11 and that is suitable for measuring the stresses applied by the body of a bed-bound patient on the inflatable cells 12 of the support device 11, said morphology sensor 9 comprising, in one embodiment of it, at least one Force Sensing Resistor (FSR), in particular as described in the Applicant's Patent Applications EP 08 163 149.1 and U.S. patent application Ser. No. 12/199,869.

The term "Force Sensing Resistor" or "FSR" is a registered trademark, and such an FSR is of extremely simple structure and of particularly low cost compared with other electronic components, and the pressure sensor can thus be of extremely low cost.

In addition, a Force Sensing Resistor, which is an electronic component whose impedance decreases with increasing intensity of a force applied perpendicularly to its surface, is relatively insensitive to noise and to vibration, thereby making it easier to take measurements and to make use of them. Since an FSR has a wide range of impedance, it is also possible to use electronics of simplified interface and of simplified use, as are the electronics of the inflation device 1 of this embodiment.

The alternating inflation method of the illustrative embodiment is applied to only certain inflatable cells 12 of said mattress 11 in a particular support zone thereof, and in particularly only to the inflatable cells 12C of the central support zone 11C of the mattress 11 that serves to support the sacral zone of a person lying or sitting on the mattress 11, the inflatable cells in the support zone 11T for supporting the torso of a patient and the cells of the support zone 11P for supporting the legs and/or feet being maintained substantially constantly between the regulation pressure Pr and the setpoint pressure since they are connected upstream from the solenoid valves $\mathbf{14}_1$ and $\mathbf{14}_2$.

It should be noted that the time required for inflating and deflating the cells 12C1, 12C2 varies as a function of the patient. It is a function of the morphology of the patient because it depends on the inflation time required to reach the regulation pressure necessary to support the patient properly in the mattress 11, and on the volume of air occupied by the body immersed in the inflatable cells 12C1, 12C2 of the central support zone 11C of the mattress.

Figure 4:
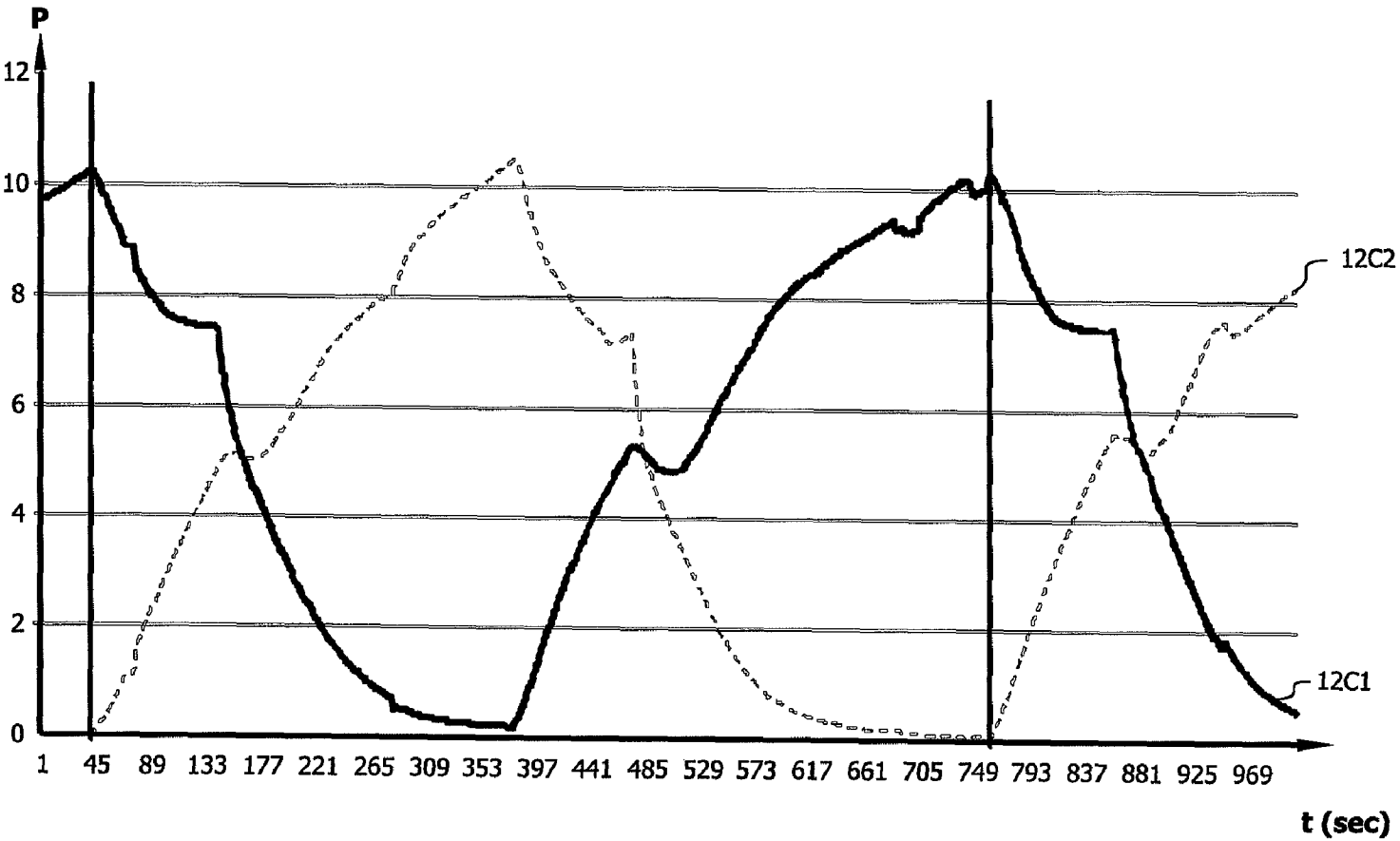
FIG. 4 shows curves of pressure variations in an inflatable support device operating using the method of the disclosure, for a person weighing 125 kg and for an inclination of zero of the support device.
Figure 7:
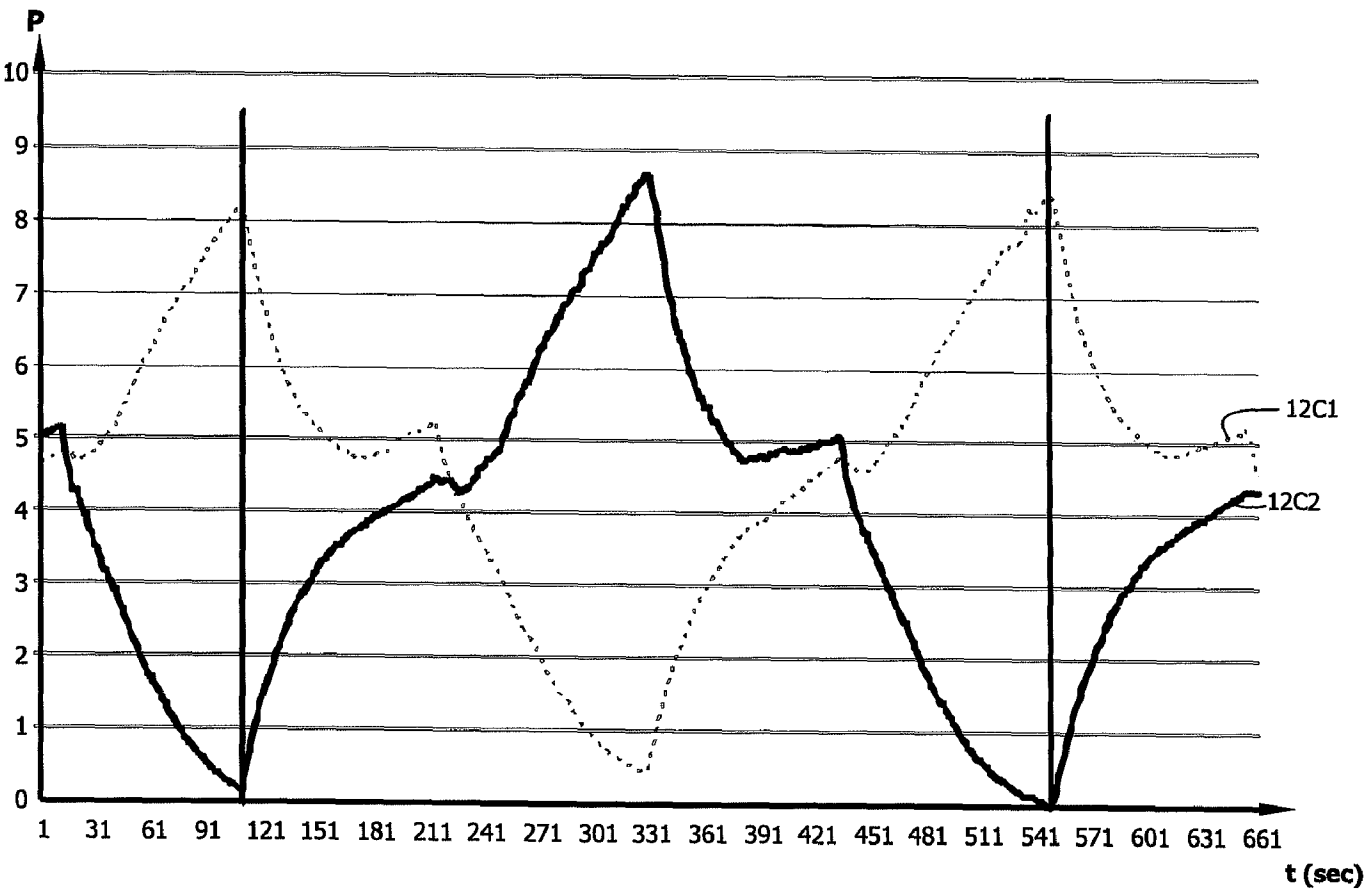
FIG. 7 shows curves of pressure variations in an inflatable support device operating using the method of the disclosure, for a person weighing 45 kg and for an inclination of zero of the support device.

This variation in the times of the inflation and deflation stages during the alternating inflation method disclosed herein is, for example, shown by the curves presented in FIGS. 7 and 4. It is also possible to observe in these figures that, for a person weighing 45 kg and measuring 160 centimeters (cm) in height, the total time of a full inflation and deflation cycle for a cell is about 420 seconds whereas the same full inflation and deflation cycle for a cell is about 700 seconds for a person weighing 125 kg and measuring 170 cm in height. In addition, in the example shown in FIG. 7, the setpoint pressure Pc to be reached in order to trigger alternating inflation of the cells 12C1 and 12C2 is lower than in the example of FIG. 4, the range of regulation pressures Pr being similar in both examples.

Figure 2:
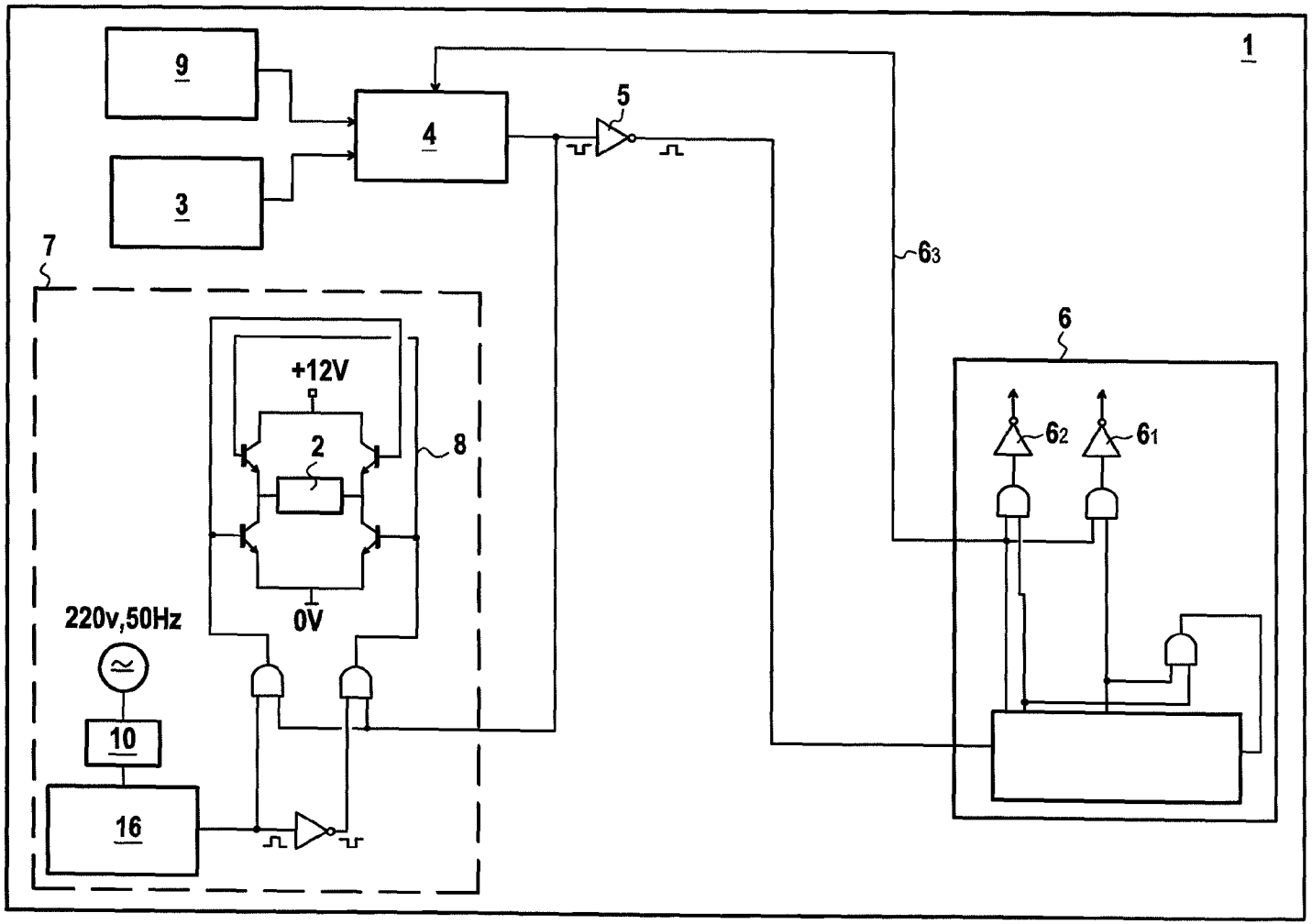
FIG. 2 diagrammatically shows the electrical structure of an alternating inflation device of the present disclosure.

It should also be noted that any inclination of any portion of the mattress 11 also has an influence on the time of a full inflation and deflation cycle for the cells 12C1, 12C2. Such inclination occurs frequently when a therapeutic mattress such as the mattress 11 of FIG. 2 is used on healthcare treatment beds equipped with torso-raising means.

Figure 5:
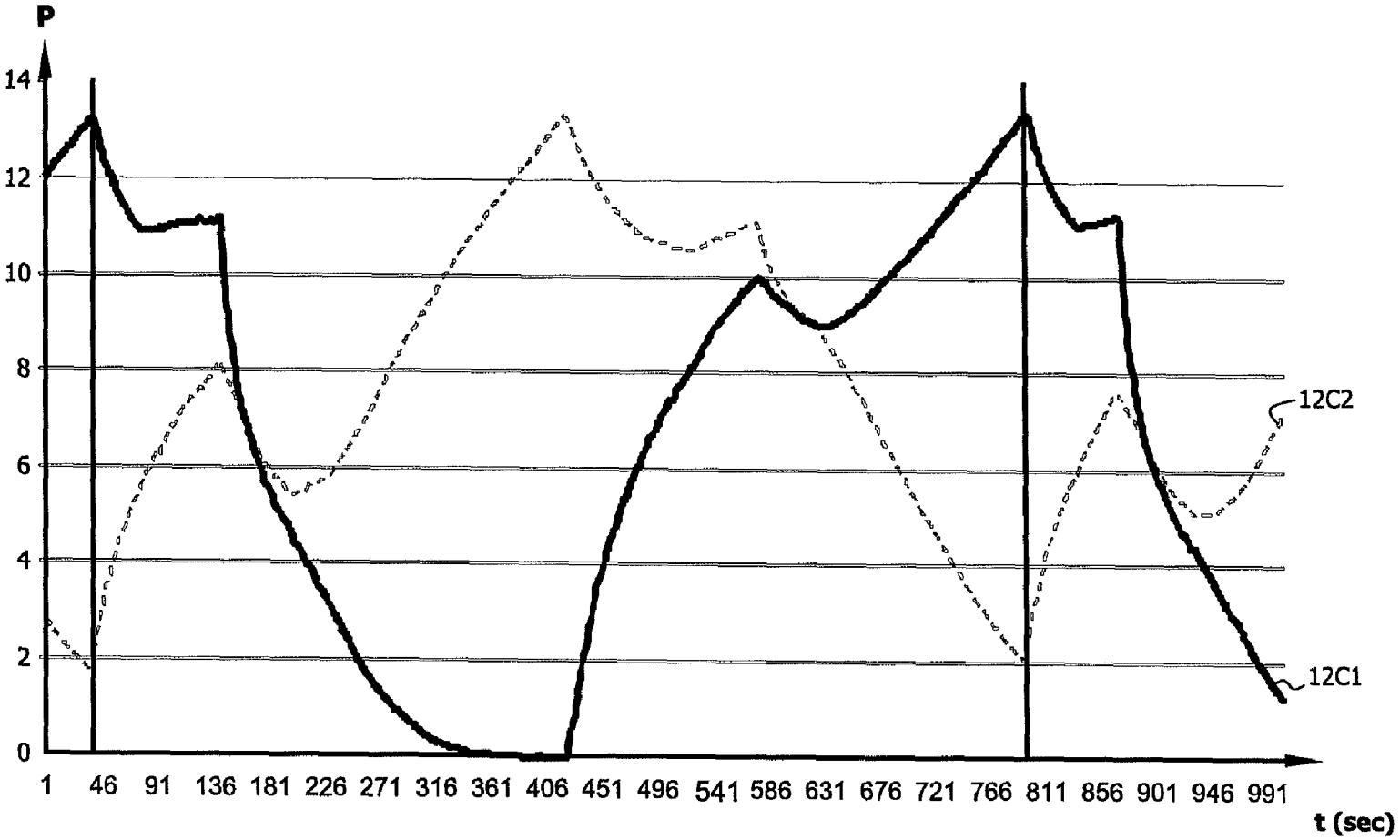
FIG. 5 shows curves of pressure variations in an inflatable support device operating using the method of the disclosure, for a person weighing 125 kg and for an inclination of 60° between two zones of the support device.
Figure 6:
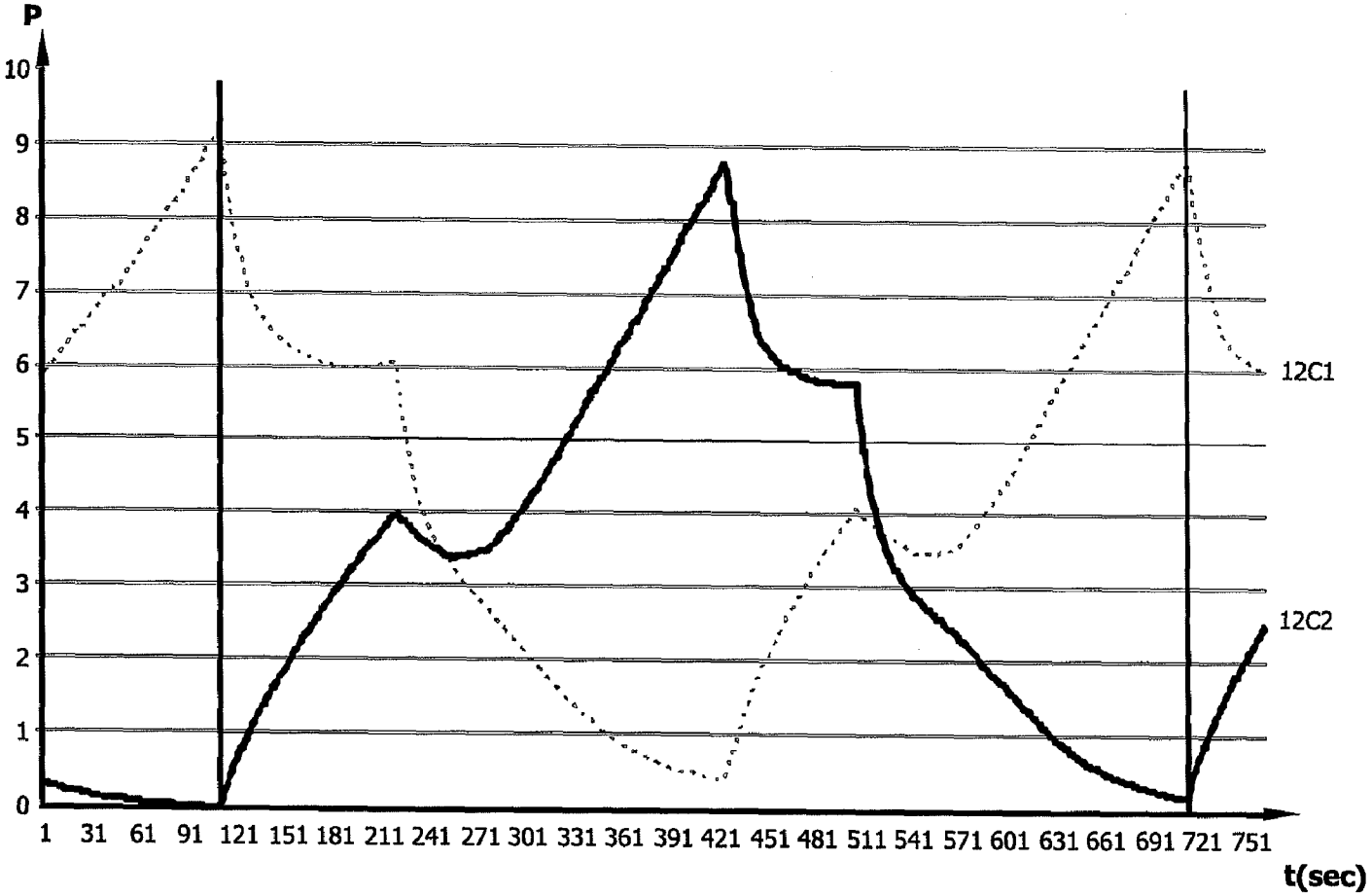
FIG. 6 shows curves of pressure variations in an inflatable support device operating using the method of the disclosure, for a person weighing 45 kg and for an inclination of 60° between two zones of the support device.

FIGS. 6 and 5, which show the pressure variation curves for the cells 12C1 and 12C2 of the central support zone 11C of the mattress 11 of FIG. 3 while the alternating inflation method disclosed herein is being implemented with the torso support zone 11T of the mattress being inclined at 60° relative to the leg support zone 11P, thus shows that such an inclination also causes an increase in the time of the re-inflation and deflation cycle for the cells 12C1, 12C2 subjected to alternating inflation.

As it thus appears from the curves presented in FIGS. 3 to 7, and from the preceding description, the alternating inflation method contemplated by the present disclosure is not constrained by permanently set adjustment parameters, but rather it adapts automatically to the conditions of use of the support device on which the device is implemented and to the particular characteristics of the people installed on the support device so that the inflation pressures and the cycle times adjust automatically, which, with the illustrative embodiment, is made possible essentially by the use of the inflation pump off signal as an element for controlling the alternating inflation of the cells of the support device.

The invention claimed is:

1. A method of inflating, in alternating manner, inflatable cells of a mattress for supporting the body of a patient, said mattress being made up of cells that are inflatable with air and having at least one zone made up of a first series and a second series of inflatable cells, the cells of each series communicating pneumatically with one another and with an inflation means, the cells of each series of cells being controlled to be either in a first state in which communication is open with the inflation means and with the other cells of the respective series of cells or in a second state in which communication is closed with the inflation means and with the other cells of the respective series and is open to ambient, the method comprising alternating deflation and re-inflation cycles so that each of said series of cells is deflated and then re-inflated in alternation and in succession, said first series of cells being deflated and then re-inflated simultaneously respectively with the re-inflation and with the deflation of said second series of cells, the alternating deflation and re-inflation of said first and second series of cells of the support device including at least one step of inflating said first and second series of cells to a value of a reference pressure whose value is determined on the basis of a substantially continuous measurement taken by means of a morphology sensor which is an electronic component measuring the stress generated by the patient's body on the first and second series of cells, wherein the alternating deflation and re-inflation of said first and second series of cells take place in a cycle controlled by said inflation means being switched on or off, which switching on or off is controlled as a function of the values of the pressures of the fluid measured inside said first and second series of cells and of comparison of said values with said reference pressure value, said inflation means being switched on or off causes said first or second series of cells to be put into the first state in which communication is open with said inflation means or into the second state in which communication is closed therewith, wherein the first and second series of cells have associated therewith respective first and second electrically controlled valves, and wherein an upstream group of the cells of each of the first and second series of cells are upstream of the respective first and second electrically controlled valves such that air moved by the inflation means first passes through at least one cell of the upstream group of the cells of the first and second series of cells before reaching the respective first and second electrically controlled valves.

2. A method according to claim 1, wherein:

said inflation means are switched on or off as a function of the values of the pressures of the fluid measured in said first and second series of cells and of comparison of said values with a regulation pressure that is determined as a function of the morphology of the patient and with a value of a setpoint pressure that is greater than said regulation pressure and that is computed relative to said regulation pressure; and said inflation means being switched on or off controlling which of said regulation pressure and setpoint pressure is chosen to be taken into account for said comparison for the next switching on or off of the inflation means during said cycle.

3. A method according to claim 2, wherein:

each cell of said first series of cells are connected one after another in series;

each cell of said second series of cells are connected one after another in series;

the following successive steps are performed, in which:

a) when all of the cells of the first and second series are inflated to a pressure corresponding to said regulation pressure, the inflation means being off, and the cells of each series of cells being in the state in which communication is open with the inflation means and with the cells of the other said series of cells, detection of said regulation pressure in said first and second cells, causes:

a-1) said cells of the first series of cells to deflate by being connected to the surrounding air; and a-2) said cells of the second series of cells to be over-inflated by switching the pump on until a determined setpoint pressure is reached that is greater than the regulation pressure; and b) when the setpoint pressure is reached in said cells of the second series of cells, detection of said setpoint pressure in said cells of the second series of cells causes the inflation means to be switched off and each cell of the second series of cells to be put into the state in which communication is open with the inflation means and with the cells of the first series of cells, thereby making it possible for fluid to be transferred from said cells of the second series of cells to said cells of the first series of cells, and thus for said second series of cells to be deflated, and, simultaneously, for said first series of cells to be re-inflated, to a said regulation pressure; and c) when all of said cells of the first and second series of cells are at a pressure corresponding to said regulation pressure, detection of a said regulation pressure in said cells causes the inflation means to be switched off, which switching off of the pump causes:

c-1) said cells of the second series of cells to be deflated by being connected to the surrounding air; and c-2) said cells of the first series of cells to be over-inflated by switching the inflation means on until said setpoint pressure is reached; and d) when said setpoint pressure is reached in said cells of the first series of cells, detection of said setpoint pressure in said cells of the first series of cells causes the inflation means to be switched off and each of the cells of the first series of cells to be put into the state in which communication is open with the inflation means and with the cells of the second series of cells, thereby making it possible for fluid to be transferred from said cells of the first series of cells to said cells of the second series of cells, and thus for said cells of the first series of cells to be deflated, and, simultaneously, for said cells of the second series of cells to be inflated to said regulation pressure; and e) repeating steps a) to d).

4. A method according to claim 2, wherein the setpoint pressure is determined relative to the regulation pressure so as to be greater by at least 10% than the regulation pressure.

5. A method according to claim 1, wherein during a first portion of time of the alternating deflation and re-inflation cycles, air is transferred from the cells of the first series of cells to the cells of the second series of cells and during a second portion of time of the alternating deflation and re-inflation cycles, air is transferred from the cells of the second series of cells to the cells of the first series of cells.

6. A method according to claim 1, wherein the first electrically controlled valve comprises a first solenoid valve and wherein the second electrically controlled valve comprises a second solenoid valve.

7. A method according to claim 1, wherein the morphology sensor comprises a force sensitive resistor device.

8. A method according to claim 1, wherein a downstream group of the cells of each of the first and second series of cells are downstream of the respective first and second electrically controlled valves.

9. A method according to claim 8, wherein the morphology sensor is located underneath the downstream group of cells.

10. A method of inflating, in alternating manner, inflatable cells of a mattress for supporting the body of a patient, said mattress being made up of cells that are inflatable with air and having at least one zone made up of a first series and a second series of inflatable cells, the cells of each series communicating pneumatically with one another and with an inflation means, the cells of each series of cells being controlled to be either in a first state in which communication is open with the inflation means and with the other cells of the respective series of cells or in a second state in which communication is closed with the inflation means and with the other cells of the respective series and is open to ambient, the method comprising alternating deflation and re-inflation cycles so that each of said series of cells is deflated and then re-inflated in alternation and in succession, said first series of cells being deflated and then re-inflated simultaneously respectively with the re-inflation and with the deflation of said second series of cells, said inflation means being switched on or off causes said first or second series of cells to be put into the first state in which communication is open with said inflation means or into the second state in which communication is closed therewith, wherein the first and second series of cells have associated therewith respective first and second electrically controlled valves, and wherein an upstream group of the cells of each of the first and second series of cells are upstream of the respective first and second electrically controlled valves such that air moved by the inflation means first passes through at least one cell of the upstream group of the cells of the first and second series of cells before reaching the respective first and second electrically controlled valves.

11. A method according to claim 10, wherein a downstream group of the cells of each of the first and second series of cells are downstream of the respective first and second electrically controlled valves.

12. A method according to claim 10, further comprising a sensor located underneath the downstream group of cells, the sensor providing a signal that is used to establish a reference pressure for the first and second series of cells.

13. A method according to claim 12, wherein the sensor comprises a force sensitive resistor device.

14. A method according to claim 10, wherein the first and second electrically controlled valves each comprise an inline compact solenoid valve.

* * * * *